United States Patent [19]

Hayes

[11] Patent Number: 4,857,881

[45] Date of Patent: Aug. 15, 1989

[54] JOYSTICK WITH SPRING DISCONNECT

[75] Inventor: Charles L. Hayes, Carlsbad, Calif.

[73] Assignee: Hayes Technology, San Marcos, Calif.

[21] Appl. No.: 216,830

[22] Filed: Jul. 8, 1988

[51] Int. Cl.[4] ..... H01C 10/16

[52] U.S. Cl. ..... 338/128; 74/471 XY

[58] Field of Search ..... 338/128; 74/471 XY

[56] References Cited

U.S. PATENT DOCUMENTS 4,489,304 12/1984 Hayes ..... 338/128

4,620,176 10/1986 Hayes ..... 338/128

4,763,100 8/1988 Wood ..... 338/128

*Primary Examiner*—Donald A. Griffin

*Attorney, Agent, or Firm*—Price, Gess & Ubell

[57] ABSTRACT

A joystick mechanism having a barrel rotator is capable of multiple axis movement and multiple axis analog signal control. The joystick mechanism can be selectively spring centered on two axes, spring centered on one axis and frictionally positioned on the other, or frictionally positioned on both axes. A pair of switch mechanisms, one for each axis of movement, selectably engage or disengage the respective centering spring mechanism. The analog signal generators are adjustable from the outside to provide biasing as required.

28 Claims, 3 Drawing Sheets

JOYSTICK WITH SPRING DISCONNECT

BACKGROUND OF THE INVENTION

1. Field of the Invention

The present invention relates generally to improvements in joystick mechanisms, and more particularly, pertains to new and improved joysticks wherein a barrel rotator is utilized for movement along one axis.

2. Description of the Prior Art

In the field of joystick mechanisms wherein barrel rotators are utilized, it has been the practice to employ a spring return to center mechanism. Such devices have been unsatisfactory for use as input devices in computer systems requiring multi-directional, positional control. The spring return to center type device is more advantageously utilized for computer games and such.

SUMMARY OF THE INVENTION

A joystick mechanism having a barrel rotator is adapted for multiple axis movement and multiple axis analog signal control. The control lever is selectively spring centered on two axes, spring centered on one axis and frictionally positioned on the other, or frictionally positioned on both axes. A switch mechanism for each axis selectively engages or disengages the spring centering mechanism for that axis of movement. The entire joystick mechanism is made of plastic parts, except for the springs.

BRIEF DESCRIPTION OF THE DRAWINGS

The general objects and many of the attendant advantages of this invention will be readily appreciated as the same becomes better understood by reference to the following detailed description when considered in conjunction with the accompanying drawings in which like reference numerals designate like parts throughout the figures thereof and wherein.

DESCRIPTION OF THE PREFERRED EMBODIMENTS

Figure 1:
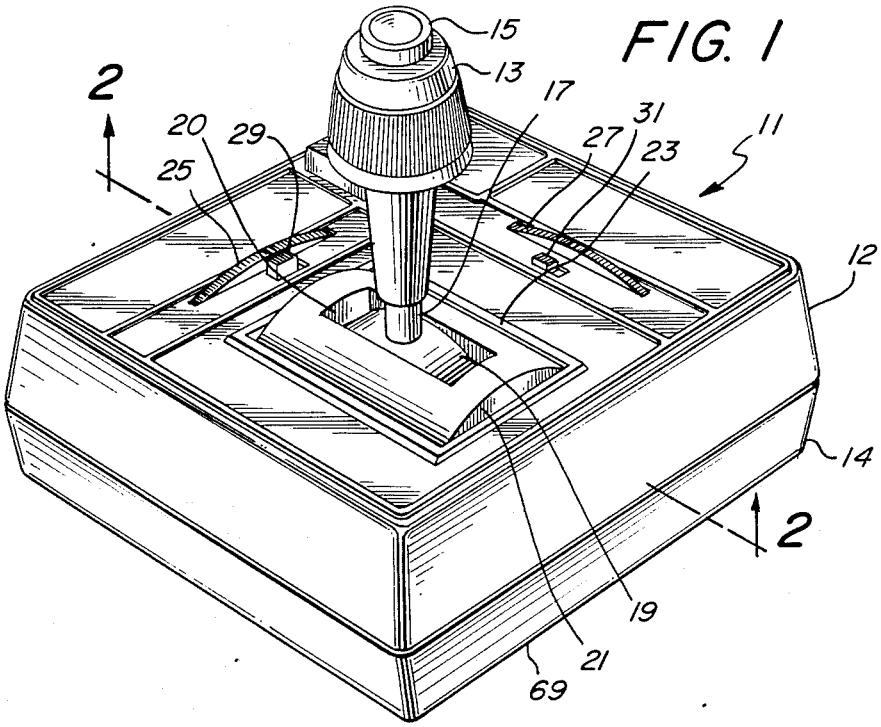
FIG. 1 is a perspective view of a joystick employing the present invention.

A joystick 11, according to the present invention, is illustrated in perspective in FIG. 1. The joystick includes a handle 13 attached to stick shaft 17 which has an expanded rotating section 19 that fits within an aperture 20 within a barrel rotator 21. Barrel rotator 21 is located within an aperture 23 of the housing 12 of the joystick.

The housing includes a pair of adjusting wheels 25 and 27 for zeroing the electrical output potentiometer. The housing 12 supports a pair of finger actuatable switch mechanisms 29 and 31 which engage and disengage the spring return mechanism contained within the joystick 11 in a manner that will be explained hereinafter. The joystick also has a fire button 15 located on the handle 13. The housing 11 may contain other control buttons as desired.

Figure 2:
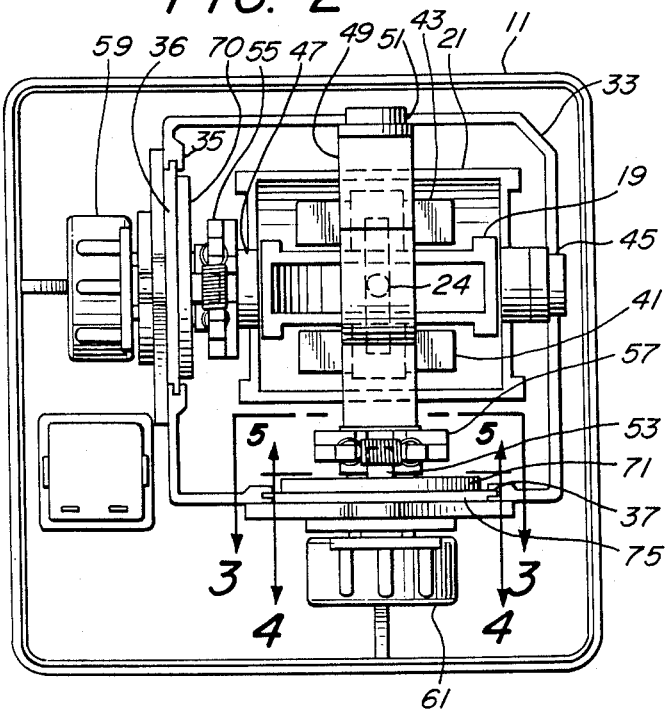
FIG. 2 is a bottom plan view taken along line 2—2 of FIG. 1 showing the workings of the invention.

Referring now to FIG. 2, which is looking at the bottom of the joystick of FIG. 1 with the bottom part 14 removed, it can be seen that the housing 11 contains a bail 33 which supports essentially all the workings of the joystick. The housing 11 of the joystick is preferably injection molded in one piece including the bail 33. The bail supports the barrel rotating mechanism 21 by way of a rotating journal 45. The other side of the barrel rotating mechanism 21 is supported by the rotating shaft (not shown) of potentiometer 59 which extends through a support plate 36 which is held by a tongue and groove arrangement 35 by bail 33. The shaft extends through support plate 36 to journal 47 to which it is fixably attached by a press fit. So mounted, the barrel rotating mechanism 21 can rotate back and forth on journal 45 and thereby turn the shaft of potentiometer 59.

A fork mechanism 49 is also supported by the bail 33. The fork mechanism 49 is mounted by way of journal bearing 51 to bail 33 orthogonal to the rotating axis of the barrel rotating mechanism 21. Thus, the rotating axis of the fork mechanism 49 is perpendicular to the rotating axis of barrel rotating mechanism 21. The other end of the fork mechanism 49 is supported by the rotating shaft of potentiometer 61. Potentiometer 61 is supported by support plate 75 that fits within the tongue and groove arrangement 37 of bail 33.

The stick shaft 17 is mounted for rotation with respect to the barrel rotating mechanism 21 by a pair of hinges 41 and 43. These hinges 41 and 43 allow the stick shaft 17 to rotate orthogonally with respect to barrel rotating mechanism 21. By so rotating, the extended end 24 of the stick shaft 17 which contacts fork mechanism 49 causes fork mechanism 49 to also rotate thereby turning the shaft 53 of potentiometer 61.

Mounted around the journal 47 of the barrel rotating mechanism 21 is a spring return mechanism 55. This spring return mechanism causes the barrel rotating mechanism 21 to return to a center or home position after the stick shaft 17 is released by the operator. Working in conjunction with the spring return mechanism 55 is a spring return disengaging mechanism 70 which is finger actuated by means of switch 29 (FIG. 1). The spring return mechanism 55 and disengaging mechanism 70 allow the barrel rotating mechanism to either have a spring return to home mode of operation or frictional mode of operation, wherein the barrel rotating mechanism 21 stays where it is placed by the operator.

A similar spring return to home mechanism 57 and disengaging mechanism 71 are located orthogonally of the barrel rotating means 21 along the axis of rotation of the fork 49. The spring return mechanism 57 works in conjunction with fork 49 allowing the stick shaft 17 and its enlargement section 19 to be operated in a return to home mode or in a frictional mode wherein the stick shaft 17 stays where it is placed by the operator.

Figure 3A:
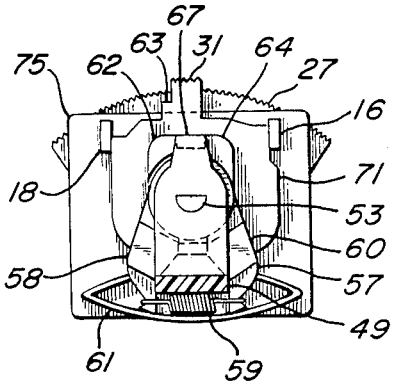
FIG. 3*a* is a sectional view taken along line 3—3 of FIG. 2.
Figure 3B:
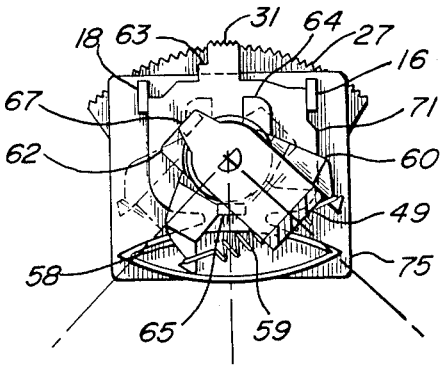
FIG. 3*b* is a sectional view taken along line 3—3 of FIG. 2.

Referring now to FIGS. 3*a* and 3*b*, a preferred structure for the spring return mechanism 57 and the spring disengaging mechanism 71 is illustrated. The spring return mechanism and spring disengaging mechanism for the barrel rotating means 21 and for the fork apparatus 49 work in the same manner. Accordingly, a structural and functional explanation of only one arrangement is deemed necessary. FIGS. 3*a* and 3*b* illustrate the spring return mechanism 57 and the spring disengaging mechanism 71 attached to the fork mechanism 49. The spring return mechanism 57 is preferably a scissors structure, which is mounted for rotation about shaft 53 of potentiometer 61. The spring return mechanism 57 has a pair of lower legs 58 and 60 which are connected respectively to a pair of upper arms 64 and 62. The lower legs 58 and 60 are held together by an expansion spring 59. Spring 59 thereby causes the upper arms 62, 64 of the scissor spring return mechanism 57 to attempt to close and thereby squeeze boss 67 which is fixedly attached to and preferably an extension of fork 49. As can be seen, the shaft 53 of potentiometer 61 extends into a press-fit fixed relation with fork 49.

Referring now to FIG. 3*b*, the movement of fork 49 to the right is illustrated. FIG. 3*b* also illustrates the spring disengaging mechanism 71 being in an inactive position. Accordingly, a boss 65, which is part of disengaging mechanism 71, is located between the legs 58 and 60 of the scissor spring return mechanism 57. As a result, movement of fork 49 to the right, as shown, causes boss 67 to force arm 62 of the scissor mechanism to the right. Because boss 65 is preventing leg 58 from moving, only leg 60 is moved against the spring tension of spring 59. As a result, when the stick shaft that is connected to fork 49 is released, it will be returned by the action of spring 59 to the home position illustrated in FIG. 3*a*. Movement of fork 49 in the opposite direction to the right causes boss 67 of fork 49 to move the arm 64 to the right. Boss 65 of the disengaging mechanism 71 thereby holds leg 60 permitting only movement of leg 58 against a spring tension 59. In this manner, rotation to the right or left is against the tension of spring 59. Release of the stick shaft will allow the tension of spring 59 to return the fork 49 and commensurately, the stick shaft 17 to its home position.

In order to disengage the spring return mechanism and eliminate its effect on the movement of the fork 49, a finger actuatable button 31 must be moved.

Figure 4A:
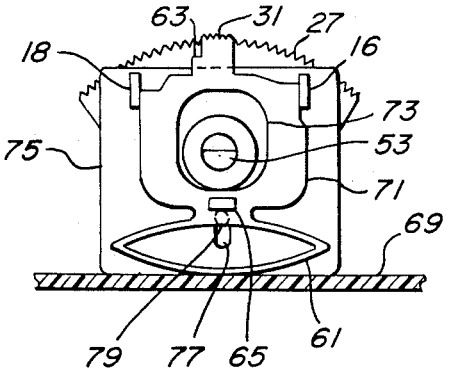
FIG. 4*a* is a sectional view taken along line 4—4 of FIG. 2.
Figure 4B:
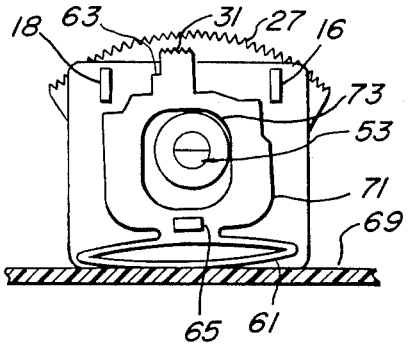
FIG. 4*b* is a sectional view taken along line 4—4 of FIG. 2.

Referring now to FIGS. 4*a* and 4*b* the spring disengaging mechanism is more clearly illustrated. A support plate 75, which is held within bail 33 by means of tongue and groove arrangement 37 (FIG. 2), supports the spring disconnect mechanism 71. The finger actuatable button 31 and a compression leaf spring mechanism 61 are an integral part of the disconnect mechanism 71. In its unactuated state, the spring disconnect mechanism 71 is located between a pair of guides 16, 18 which are part of the support plate 75. In addition, a journal 79 extends from the side opposite boss 65 into a groove 77 within support plate 75, thus allowing disengaging mechanism 71 to move up and down with respect to the base 69 of the housing for the joystick 11. An aperture 73 within spring disengaging mechanism 71 surrounds the rotating shaft 53 of potentiometer 61 which extends through the support plate 75. The boss 65 in the position indicated in FIG. 4*a* is in a position to engage the legs 58 and 60 of the scissor spring return mechanism 57 shown in FIGS. 3*a* and 3*b*.

Referring now to FIG. 4*b*, which illustrates the position of spring return disengaging mechanism 71 when the scissor mechanism is being disengaged, the finger actuatable button 31 is caused to be depressed and moved to the left. This causes the leaf spring 61 to compress and the boss 65 attached to disengaging mechanism 71 to move down with respect to base 69. By moving the finger actuatable switch 31 to the left, ridge 63 catches under the edge of a slot (not shown) located in the top of the housing 12 (FIG. 1) thereby holding the leaf spring 61 in a compressed state and maintaining boss 65 in its downward direction.

Figure 6:
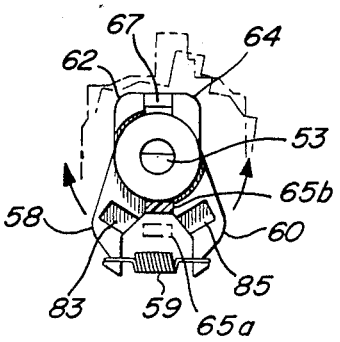
FIG. 6 is a sectional view of the scissor mechanism for the present invention.

When the boss 65 is located in its downward direction, as illustrated in FIG. 6, it is aligned with a pair of apertures 83, 85, respectively, cut into legs 58, 60 of the scissor spring return mechanism. With the boss 65 in the position 65*a*, movement of the fork causes the boss 67 attached thereto to move arms 62 or 64, depending on whether movement is to the right or to the left. Compression spring 59 maintains arms 62 and 64 in compression against boss 67. Because boss 65*a* is in the position indicated, it will not hold either lower leg 58 or 60, thereby allowing the entire scissor mechanism to rotate. The fork mechanism thus stops in the position placed by the operator of the stick shaft 17. This results in the friction mode.

With the boss 65 placed in the position 65*b* indicated in FIG. 6, as a result of the spring disengaging mechanism 71 being in the position shown in FIG. 4*a*, one can see that boss 65*b* does contact both lower legs 58, 60 of the spring scissor mechanism. If fork mechanism is moved to the right or the left causing the boss 67 to force either arm 62 to the left or arm 64 to the right, the opposite lower leg 58 or 60 is held in place by the boss 65*b*. This results in the spring return to home mode.

Figure 5:
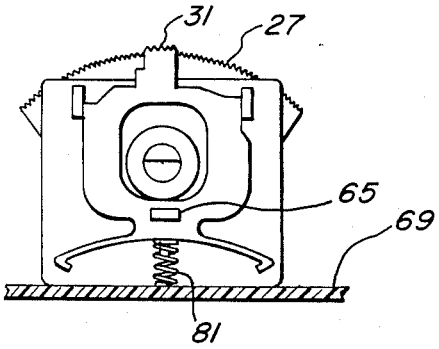
FIG. 5 is a sectional view taken along line 5—5 of FIG. 2.

Rather than using a leaf spring 61 as illustrated in FIG. 4, a compression spring 81, as illustrated in FIG. 5, may be utilized as an alternate preferred embodiment.

Figure 7A:
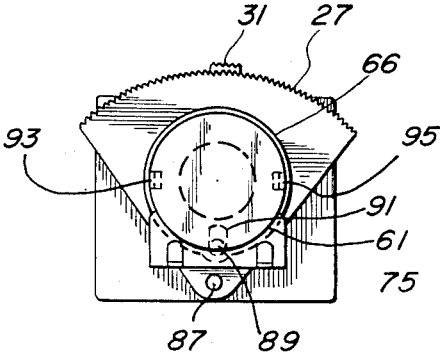
FIG. 7*a* is a sectional view of the potentiometer adjusting mechanism.

FIG. 7 illustrates the potentiometer zeroing mechanism. An adjustment wheel 27 pivots on a shaft 87 that is journalled within support plate 75. A shaft 89 is fixedly attached to and extends out from the adjustment wheel 27. This shaft fit within an aperture 29 of potentiometer support plate 66 on which the potentiometer 61 is mounted by means of tabs 93, 95 inserting into apertures in support plate 66.

Figure 7B:
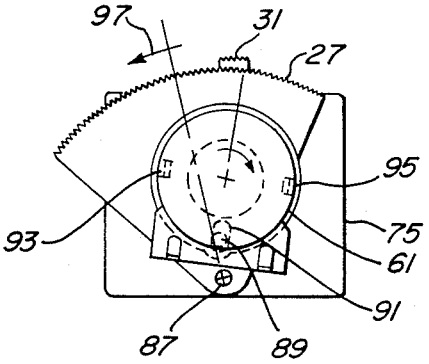
FIG. 7*b* is a sectional view of the potentiometer adjusting mechanism in an alternate position.

Referring to FIG. 7*b*, it is assumed that the adjustment wheel 27 is moved to the left direction 97 causing it to pivot on shaft 87. Shaft 87 is journalled into an aperture of adjustment wheel 27, and it is fixedly attached to support plate 75. Such pivoting motion in the direction 97 causes the entire body of potentiometer 61 to pivot to the right around pivot shaft 89. With the shaft of potentiometer 61 held stationary, the analog or electrical home or zero position is thereby adjusted as desired.

Figure 8:
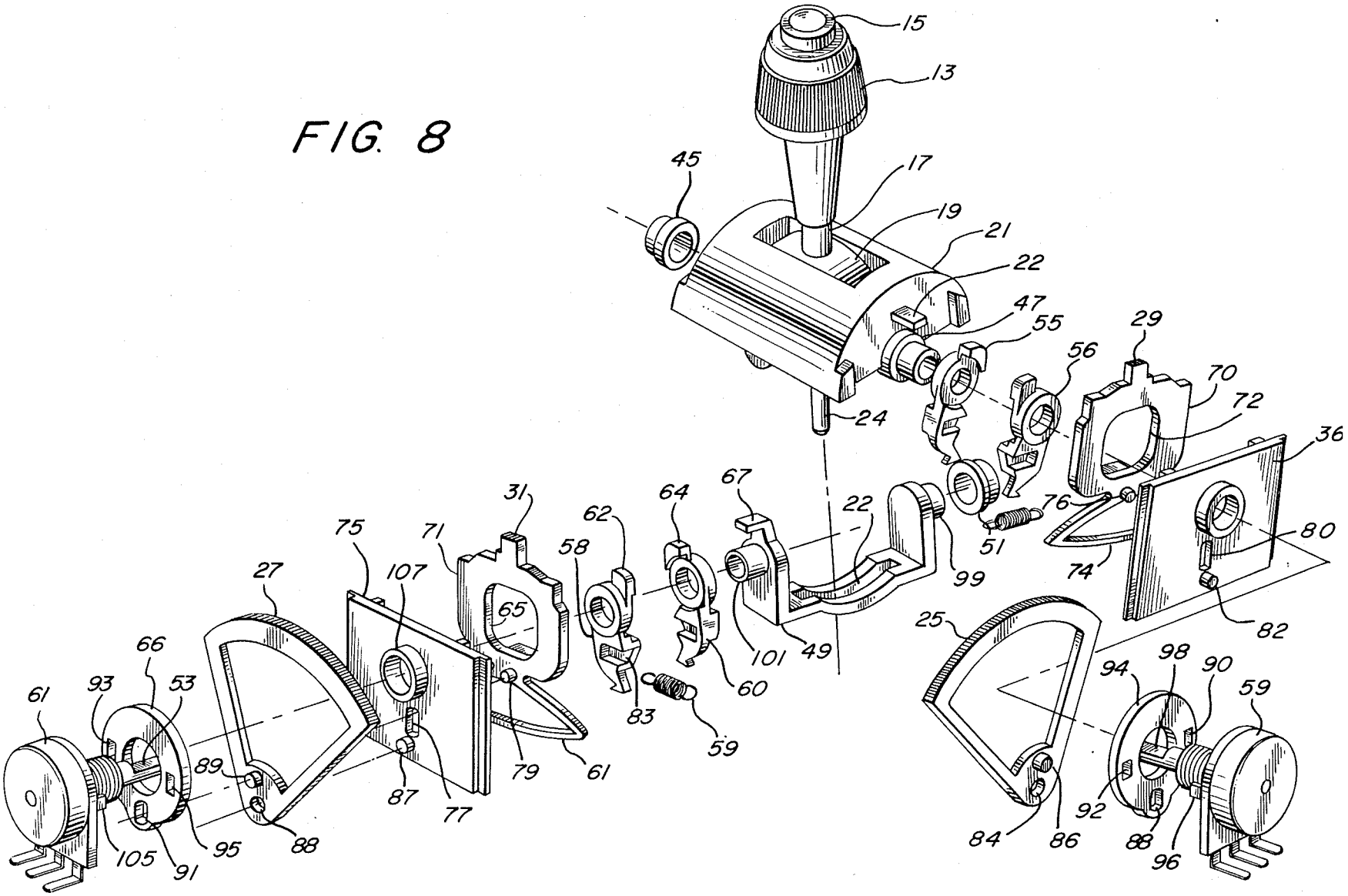
FIG. 8 is an exploded view showing all the components of the present invention.

Refer now to FIG. 8, which is an exploded view of all the parts, other than the housing, associated with the joystick mechanism. The stick shaft 17 is attached to stick shaft enlargement 19 which is hinged to the bottom side of barrel rotating mechanism 21, as previously explained. Stick shaft 17 can rotate about its axis of rotation, which is perpendicular to the axis of rotation of barrel rotating mechanism 21. Stick shaft 17 by way of its extension tip 24 engages fork 49 at the slot 22 therein. Moving stick shaft 17 without moving the barrel rotating mechanism 21 causes the fork 49 to rotate about its axis of rotation, which is located symmetrically within bearing bosses 101 and 99.

Rotating barrel rotating mechanism 21 about its axis of rotation, which is symmetrically within bearing bosses 47 and 45, will cause the extension 24 of stick shaft 17 to simply move within the slot 22 of fork 49 without causing it to rotate. Thus, as can be seen, barrel rotating mechanism 21 causes rotation along one orthogonal axis and stick shaft 17 rotation within barrel mechanism 21 causes rotation along another orthogonal axis through fork mechanism 49. It should be understood, of course, that both the barrel rotating mechanism 21 and fork mechanism 49 may be rotating at the same time as a result of angular movement of stick shaft 17 by the operator.

Barrel rotating mechanism 21 has fixedly attached at one end thereof a boss 22, which extends into and between the two arms 55 and 56 of the scissor spring return mechanism. Arms 55 and 56 of the spring return mechanism rotate on bearing surface 47. As can be seen, boss 22 will move arms 55 and 56 of the spring return mechanism as the barrel rotating mechanism 21 moves. The spring disconnect mechanism 70, having a finger actuatable button 29 attached thereto and a leaf spring 74 at the opposite end thereof, is mounted to support plate 36 by means of shaft 76 extending from disconnect structure 70 into slot 80 of support plate 36. Disconnect mechanism 70 rides up and down in slot 80 against the compression of leaf spring 74 as a result of pressure placed on finger actuatable button 29.

On the opposite side of support plate 36, another journal shaft 82 extends out and is journalled into aperture 84 of adjusting wheel 25. Adjusting wheel 25 has a journal shaft 86 extending out from its opposite side to fit within a slot 88 in potentiometer support ring 94. Support ring 94 has a pair of slots 92 and 90 therein for receiving tabs 96 of potentiometer 59 causing the potentiometer to be held fast to support ring 94. The shaft 98 of potentiometer 59 extends through the apertures of the various parts and into press-fit engagement with the bearing boss 47 of the barrel rotating mechanism 21.

Referring now to the structure utilized along the axis of the fork 49, it can be seen that the fork 49 rotates around its bearing bosses 99 and 101. Bearing boss 99 fits within bearing sleeve 51. Bearing boss 101 receives the two arms of the scissor mechanism so that boss 67 fits in between upper arms 62 and 64 of the scissor mechanism. Spring 59 attaches to hook-type engagement means of the legs 60 and 58 of the scissor mechanism causing them to be pulled together and forcing the arms 62, 64 against the boss 67 of the fork 49. A pair of apertures 83 are located in the legs 58 and 60 of the spring return mechanism.

The spring disconnect mechanism 71 with its finger actuatable button 31, an integral part thereof, and a leaf spring mechanism at the opposite end thereof is slidably mounted to support plate 75 by way of extension shaft 79 slidably engaging slot 77 in the support plate 75. Shaft 79 is fixedly attached to disengaging mechanism 71. On the opposite side of disengaging mechanism 71, boss 65 extends therefrom and fits within the legs 58 and 60 of the spring scissor mechanism.

The spring disconnect mechanism 71 is allowed to move up and down within slot 77 causing the boss 65 to move likewise. In an upper position, boss 65 maintains one leg or the other of the scissor mechanism stationary. In a lower position, boss 65 merely slides within the apertures 83 within the legs 58, 60 of the scissor mechanism allowing the entire mechanism to rotate with the fork 49.

The support plate 75 has a bearing shaft 87 extending therefrom which is journalled into an aperture 88 of adjustment wheel 27 allowing wheel 27 to pivot about journal shaft 87. A journal shaft 89 mounted on adjustment wheel 27 fits within slot 91 of potentiometer support ring 66. Potentiometer support ring 66 has a pair of slots 93, 95 which receive tabs 105 of potentiometer 61 so that the potentiometer 61 is fixedly attached to support ring 66. The shaft 53 of potentiometer 61 extends through the apertures of the various parts noted and is press-fit into an aperture within bearing boss 101 of fork 49.

What is claimed is:

1. An improved joystick mechanism, comprising:

a housing;

a barrel-shaped rotating means supported for rotation along a first axis in said housing;

a stick shaft engaging and protruding through an aperture in said barrel rotating means and being hinged thereto for rotating along a second axis;

a first potentiometer connected to said barrel rotating means for activation thereby;

a fork member supported for rotation along a second axis in said housing, said stick shaft having one end thereof engaging and rotating said fork member; and a second potentiometer connected to said fork member for activation thereby.

2. The improved joystick mechanism of claim 1 further comprising:

a first mechanism means for biasing said barrel rotating means towards a neutral center position, whereby whenever said stick shaft is released, the barrel rotates to its center position; and a second mechanism means for biasing said fork member towards a neutral center position whereby whenever said stick shaft is released, the fork member rotates to its center position.

3. The improved joystick mechanism of claim 2 further comprising:

a first disconnect means for disengaging said first biasing mechanism, thereby causing said barrel rotating means to remain in the position placed by said stick shaft; and a second disconnect means for disengaging said second biasing mechanism, thereby causing said fork member to remain in the position placed by said stick shaft.

4. The improved joystick mechanism of claim 3 wherein said barrel rotating means engages and rotates the shaft of said first potentiometer.

5. The improved joystick mechanism of claim 3 wherein said fork member engages and rotates the shaft of said second potentiometer.

6. The improved joystick mechanism of claim 3 wherein said first biasing means for biasing said barrel rotating means towards a center position comprises:

a scissor mechanism means mounted for rotation with said barrel rotating means;

an expansion spring connected to a first end of the pair of arms of said scissor mechanism, tending to force the first end and the opposite second end pair of arms together; and a boss fixedly attached to said barrel rotating means and extending between the pair of arms at the second end of said scissor mechanism, whereby movement of said barrel rotating means back and forth along its axis moves said boss and said scissor mechanism in the same direction as said barrel rotating means.

7. The improved joystick mechanism of claim 6 wherein each one of said pair of arms of said scissor mechanism has a recess formed therein at the spring end.

8. The improved joystick mechanism of claim 7 wherein said first disconnect means for disengaging said first biasing mechanism comprises:

a first finger actuatable member movable in a direction perpendicular to the axis of rotation of said scissor mechanism;

a spring means tending to bias said first finger actuatable member in a first direction; and a boss fixedly attached to said first finger actuatable member for engaging the pair of arms of said scissor mechanism at the spring end thereof when said first finger actuatable member is biased in the first direction and engaging the recess formed therein when the first finger actuatable member is moved in the second direction, whereby said scissor mechanism is held by said boss when biased in the first direction and allowed to rotate with the drum rotating means when said boss is located in the second direction.

9. The improved joystick of claim 8 wherein said first finger actuatable member includes means to hold said member against said spring means in a position in the second direction, said position constituting the disengaging position for the first disconnect mechanism.

10. The improved joystick of claim 8 wherein said spring means comprises a leaf spring formed integral with the structure of said first finger actuatable member 11. The improved joystick of claim 8 wherein said spring means comprises a compression coil spring attached to said first finger actuatable member.

12. An improved joystick mechanism, comprising:

a housing;

a barrel-shaped rotating means supported for rotation along a first axis in said housing;

a stick shaft engaging and protruding through an aperture in said barrel rotating means and being hinged thereto for rotating along a second axis;

a fork member supported for rotation along a second axis in said housing, said stick shaft having one end thereof engaging and rotating said fork member;

a first mechanism means for biasing said barrel rotating means towards a neutral center position, whereby whenever said stick shaft is released, the barrel means rotates towards its center position;

a second mechanism means for biasing said fork member towards a neutral center position, whereby whenever said stick shaft is released, the fork member rotates to its center position;

a first disconnect means for disengaging said first biasing mechanism, thereby causing said barrel rotating means to remain in the position placed by said stick shaft; and a second disconnect means for disengaging said second biasing mechanism, thereby causing said fork member to remain in the position placed by said stick shaft.

13. The improved joystick mechanism of claim 12 wherein said first biasing means for biasing said barrel rotating means towards a center position comprises:

a scissor mechanism means mounted for rotation with said barrel rotating means;

an expansion spring connected to a first end of the pair of arms of said scissor mechanism, tending to force the first end and the opposite second end pair of arms together; and a boss fixedly attached to said barrel rotating means and extending between the pair of arms at the second end of said scissor mechanism, whereby movement of said barrel rotating means back and forth along its axis moves said boss and said scissor mechanism in the same direction as said barrel rotating means.

14. The improved joystick mechanism of claim 13 wherein each one of said pair of arms of said scissor mechanism has a recess formed therein at the spring end.

15. The improved joystick mechanism of claim 14 wherein said first disconnect means for disengaging said first biasing mechanism comprises:

a first finger actuatable member movable in a direction perpendicular to the axis of rotation of said scissor mechanism;

a spring means tending to bias said first finger actuatable member in a first direction; and a boss fixedly attached to said first finger actuatable member for engaging the pair of arms of said scissor mechanism at the spring end thereof when said first finger actuatable member is biased in the first direction and engaging the recesses formed therein when the first finger actuatable member is moved in the second direction, whereby said scissor mechanism is held by said boss when said boss is biased in the first direction and allowed to rotate with the drum rotating means when said boss is located in the second direction.

16. The improved joystick mechanism of claim 12 wherein said second biasing means for biasing said fork member towards a center position comprises:

a scissor mechanism means mounted for rotation with said fork member;

an expansion spring connected to a first end of the pair of arms of said scissor mechanism, tending to force the first end and the opposite second end pair of arms together; and a boss fixedly attached to said fork member and extending between the pair of arms at the second end of said scissor mechanism, whereby movement of said fork member back and forth along its axis moves said boss and said scissor mechanism in the same direction as said fork member.

17. The improved joystick mechanism of claim 16 wherein each one of said pair of arms of said scissor mechanism has a recess formed therein at the spring end.

18. The improved joystick mechanism of claim 17 wherein said second disconnect means for disengaging said second biasing means comprises:

a second finger actuatable member movable in a direction perpendicular to the axis of rotation of said scissor mechanism;

a spring means tending to bias said second finger actuatable member in a first direction; and a boss fixedly attached to said first finger actuatable member for engaging the pair of arms of said scissor mechanism at the spring end thereof when said second finger actuatable member is biased in the first direction, and engaging the recesses formed therein when the second finger actuatable member is moved in the second direction, whereby said scissor mechanism is held by said boss when said boss is biased in the first direction and allowed to rotate with the fork member when said boss is located in the second direction.

19. An improved joystick mechanism, comprising:

a housing;

a hand manipulatable stick means mounted in said housing for pivotal movement along at least a first and second axis;

a fork member engaged by said stick means, mounted for rotation about said second axis, and rotatable by said stick means; an output signal varying means mounted at an end of said fork and engaged thereby;

a scissors having a first and a second arm mounted for pivotal rotation about said second axis at an end of said fork;

a first boss attached to the arm of said fork and extending between the first and second arm of said scissors;

a first biasing means for biasing the first and second arms of said scissors together and against said first boss;

a second boss mounted for movement with respect to said housing at an end of said fork for movement into and out of engagement between the first and second arm of said scissors;

a second biasing means for biasing said second boss into engagement between the first and second arm of said scissors; and a switch means for moving said second boss out of engagement between said first and second arm of said scissors.

20. The improved joystick mechanism of claim 19 wherein the first and second arm of said scissors have recesses therein and said second boss moves into the recesses of said arms when it moves out of engagement between the first and second arm.

21. The improved joystick mechanism of claim 20 wherein said first boss extends between the first and second arm of said scissor above the pivotal rotation axis and said second boss extends between the first and second arm of said scissor below the pivotal rotation axis.

22. The improved joystick mechanism of claim 21 wherein said switch means is finger actuatable for moving said second boss against the bias of said second biasing means.

23. The improved joystick mechanism of claim 22 wherein said switch means can be latched in a position that holds said second boss against the bias of said second biasing means.

24. An improved joystick mechanism, comprising:

a housing;

a barrel-shaped rotating means supported for rotation about a first axis in said housing;

a hand manipulatable stick means engaging and protruding through an aperture in said barrel-shaped rotating means and being hinged thereto for rotating about a second axis;

an output signal varying means mounted at an end of said barrel-shaped rotating means and engaged thereby;

a scissors having a first and a second arm mounted for pivotal rotation about said first axis at an end of said barrel-shaped rotating means;

a first boss attached to the end of said barrel-shaped rotating means and extending between the first and second arm of said scissors.

a first biasing means for biasing the first and second arms of said scissors together against said first boss;

a second boss mounted for movement with respect to housing at an end of said barrel-shaped rotating means for movement into and out of engagement between the first and second arm of said scissors;

a second biasing means for biasing said second boss with engagement between the first and second arm of said scissors; and a switch means for moving said second boss out of engagement between said first and second arm of said scissors.

25. The improved joystick mechanism of claim 24 wherein the first and second arms of said scissors have recesses therein and said second boss moves into the recesses of said arms when it moves out of engagement between the first and second arm.

26. The improved joystick mechanism of claim 25 wherein said first boss extends between the first and second arm of said scissors above the pivotal rotation axis and said second boss extends between the first and second arm of said scissor below the pivotal rotation axis.

27. The improved joystick mechanism of claim 26 wherein said switch means is finger actuatable for moving said second boss against the bias of said second biasing means.

28. The improved joystick mechanism of claim 27 wherein said switch means can be latched in a position that holds said second boss against the bias of said second biasing means.

* * * * *